US009044375B2

(12) United States Patent
Reyes General et al.

(10) Patent No.: US 9,044,375 B2
(45) Date of Patent: Jun. 2, 2015

(54) HIGH FREQUENCY AND LOW INTENSITY VIBRATION STIMULATOR FOR THE TREATMENT OF OSTEOPOROSIS

(75) Inventors: Maria Loreto Reyes General, Santiago (CL); Micah Etan Ortuzar Dworsky, Providencia (CL); Rodrigo Eduardo Carmi Lahsen, Las Condes-Santiago (CL)

(73) Assignee: PONTIFICA UNIVERSIDAD CATOLICA DE CHILE, Santiago (CL)

( * ) Notice: Subject to any disclaimer, the term of this patent is extended or adjusted under 35 U.S.C. 154(b) by 827 days.

(21) Appl. No.: 13/126,452

(22) PCT Filed: Oct. 27, 2009

(86) PCT No.: PCT/CL2009/000018

§ 371 (c)(1), (2), (4) Date: Aug. 25, 2011

(87) PCT Pub. No.: WO2010/048738

PCT Pub. Date: May 6, 2010

(65) Prior Publication Data

US 2011/0301514 A1 Dec. 8, 2011

(30) Foreign Application Priority Data

Oct. 27, 2008 (CL) ..... 3195-2008

(51) Int. Cl.
*A61H 1/00* (2006.01)
*A61H 23/02* (2006.01)

(52) U.S. Cl.
CPC ..... *A61H 23/0218* (2013.01); *A61H 2201/165* (2013.01); *A61H 2205/06* (2013.01); *A61H 2205/10* (2013.01)

(58) Field of Classification Search
CPC ..... A61H 23/00; A61H 23/0218
USPC ..... 601/46, 48, 49, 53, 54, 66, 78, 79, 81, 601/84, 89, 90
See application file for complete search history.

(56) References Cited

U.S. PATENT DOCUMENTS

| | | | | |
|---|---|---|---|---|
| 2,026,527 | A | 1/1936 | Gonsett et al. | |
| 7,462,158 | B2 | 12/2008 | Mor | |
| 2002/0169398 | A1 * | 11/2002 | Hancock | 601/15 |
| 2005/0251068 | A1 | 11/2005 | Mor | |
| 2006/0015045 | A1 | 1/2006 | Zets et al. | |
| 2008/0015477 | A1 * | 1/2008 | Talish et al. | 601/79 |

FOREIGN PATENT DOCUMENTS

WO 2005/107868 A1 11/2005

OTHER PUBLICATIONS

International Search Report, dated Mar. 17, 2010, issued in corresponding PCT/CL2009/000018.
International Report on Patentability and Written Opinion, dated Mar. 17, 2010, issued in corresponding PCT/CL2009/000018.

* cited by examiner

*Primary Examiner* — Quang D Thanh
(74) *Attorney, Agent, or Firm* — Millen, White, Zelano & Branigan, P.C.

(57) ABSTRACT

A device that stimulates bone tissue formation capable of generating vibrations with different frequency components at the same time and that can be applied locally to different parts of the patient's body, wherein such device comprises a vibration generator capable of generating vibrations with different frequencies and variable fastener to attach to different parts of the body.

5 Claims, 5 Drawing Sheets

HIGH FREQUENCY AND LOW INTENSITY VIBRATION STIMULATOR FOR THE TREATMENT OF OSTEOPOROSIS

The present invention relates to a device which stimulates the formation of bone tissue, capable of generating vibrations with different frequency components at the same time and which can be applied locally to different parts of the body.

PREVIOUS ART

Considerable medical opinions suggest that vibrations at determined frequencies and low intensity amplitude generate significant therapeutic effects, for example, scientists have demonstrated that certain vibrations may help osseous formation, bone fracture healing, pain relieving, tendon and muscle repair, etc.

Body immobility produces loss of bone mass (osteoporosis) due to the lack of muscle stimulus for bone calcification. Studies have demonstrated that muscle activity prevents osteoporosis by producing high frequency and low intensity vibration.

For the application of these principles in subjects who do not exercise regularly or simply because they are unable to do them due to certain degrees of disability, machines that normally imparts a movement directly to the part of body where vibrations that needs to be stimulated have been developed. This vibration is produced through a movement applied with a rotary axis and a connecting rod. In most cases, the subject stands on a platform which oscillates with the aforementioned mechanism, as described in US patent US2007/0219052, where a machine with a lower platform where a subject must stand on in order to receive vibrations generated by a mechanism located under such platform is described.

Galileo platform, manufactured in Germany, is known in the previous art. It has a central pivot around which the platform oscillates as a seesaw, the greater the distance from the central axis, the greater the amplitude.

Therefore, in this type of platform, the intensity may be varied by changing the location of the feet with regard to the central axis.

This type of vibration will have an intensity (of force) that will depend on the subject's weight and on the amplitude of the platform oscillation. In the case of the Galileo Machine, such amplitude is varied by changing the position of the feet. Its frequency will depend on the speed of rotary axis, and only one frequency can be used at a time.

Most of the existing solutions are based on platform type static machines where the subject must be standing on them, which do not solve the problems that arise when the subject is unable to stand up, thereby limiting their use for other types of applications.

In order to solve the problem of a more versatile application, solutions such as the portable model, manufactured by the same manufacturer of Galileo machine, have been developed. Such model is used with the aid of the fist. In that case, the way of operation is similar to the one used by the platform with an important difference: such machine is a reaction-type machine, whereas platforms are action-type machines. This implies that the force exerted on the body depends on the oscillating mass, not on the body weight.

The way of operating of this equipment (circular oscillating mass) totally relates the intensity of vibration with the frequency, which is not desirable. However, in this equipment the oscillating mass may be changed, by adding o removing small weights. That could solve the mentioned disadvantage.

Another more versatile solution is observed in the US Patent 2007/01000262, where a bracelet emitting vibrations similar to a cat's purr is described, however its purpose aims at generating rather a psychological effect by emitting not only vibrations transmitted to the exposed tissues but also by emitting a sound at the frequency similar to a cat's purr.

Finally, it can be said that all platform-type solutions have the following disadvantages:

Subjects must be able to stand in an upright position.

The intensity of the vibration depends on the subject's mass.

Mainly works with the lower body.

Only works with one frequency at a time.

One of the technical problems addressed by the present invention is the versatility of the device so that the application can be applied to different parts of the body, allowing subjects who are unable to stand up to use the device, therefore its operation is not limited to a platform but to a portable and smaller device which can be attached to any part of the body to generate the vibration which in turn will stimulate osteogenesis (generation of bone tissue) to heal osteoporosis problems and similar conditions (fractures), as well as the prevention thereof.

Additionally, the invention addresses the problem of generating vibration at different frequencies at the same time.

The invention comprises a vibration generating machine to be applied in patients with motor problems; wherein such machine is aimed at mimicking the efforts that muscles would normally impart to osseous structure.

Thus, the invention is a reaction-type vibration machine wherein a mass is made to oscillate at a desired frequency and through reaction a vibratory force is obtained in the part of the body where the machine is attached.

The machine's shape and size are such that it can be applied to different parts of the body without the patient having to stand up as compared with the platform type devices from previous art.

DETAILED DESCRIPTION OF THE INVENTION

Figure 1:
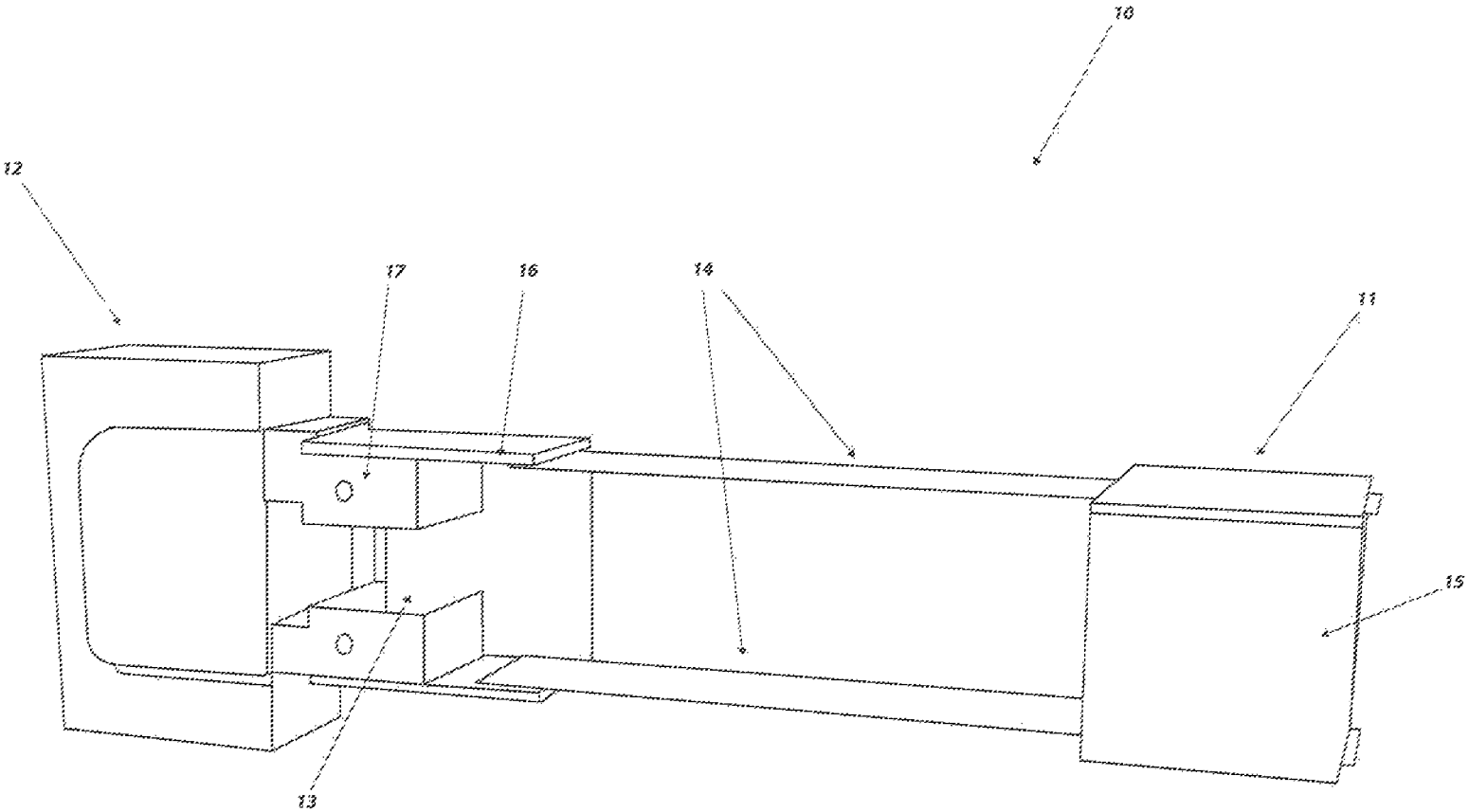
FIG. 1 depicts a perspective view of the variable frequency vibration generator for bone tissue generation.
Figure 2:
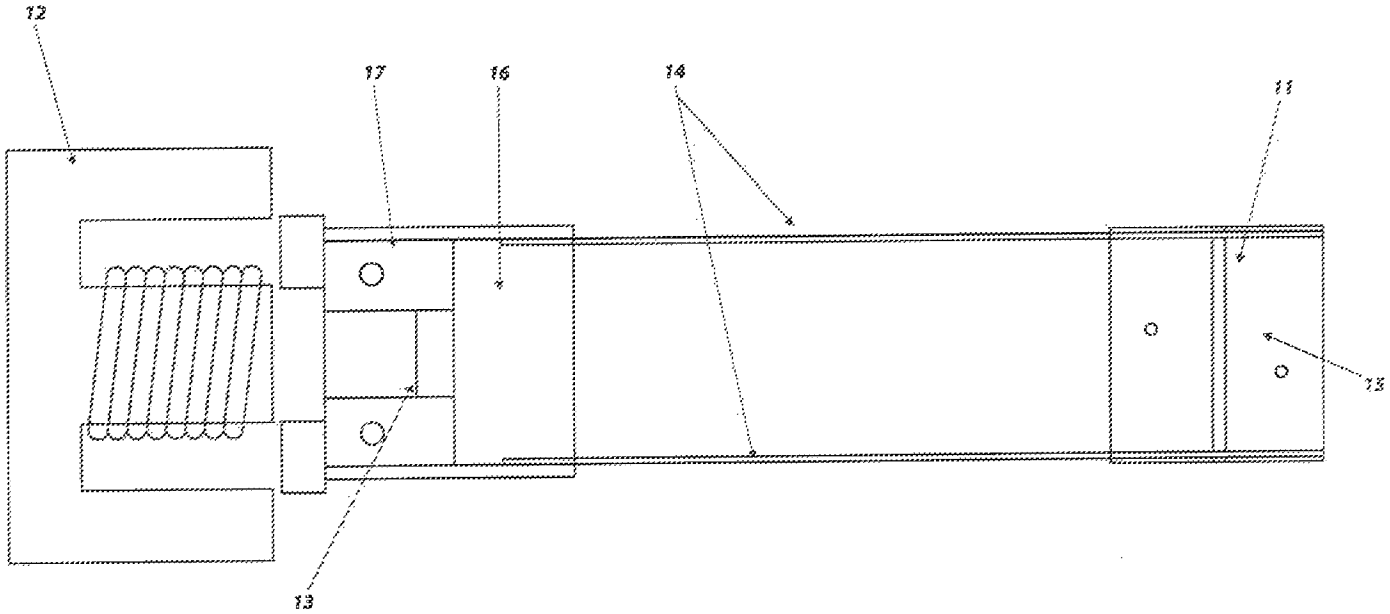
FIG. 2 depicts a front view of the variable frequency vibration generator for bone tissue generation.
Figure 3:
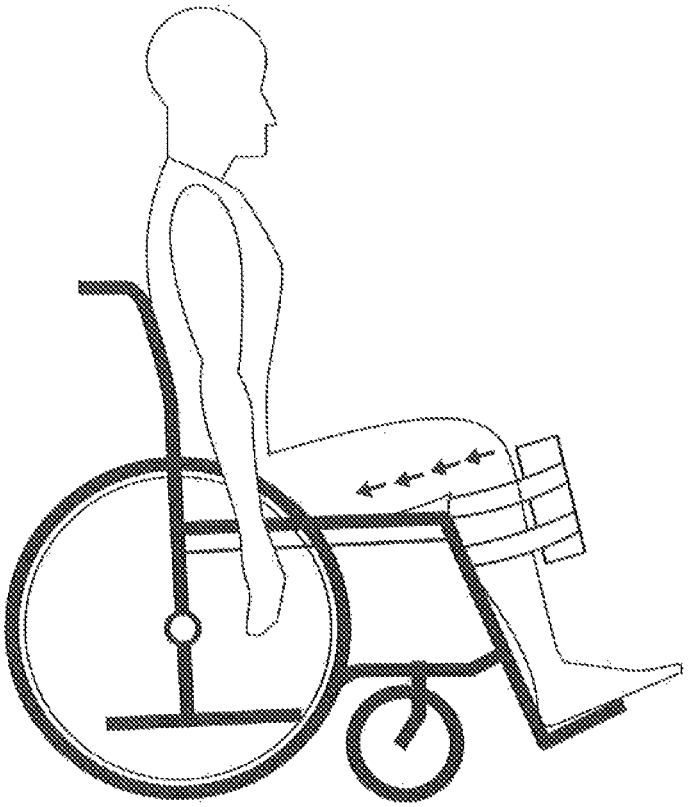
FIG. 3 depicts an illustration of the device of the invention upon stimulating the femur.
Figure 4:
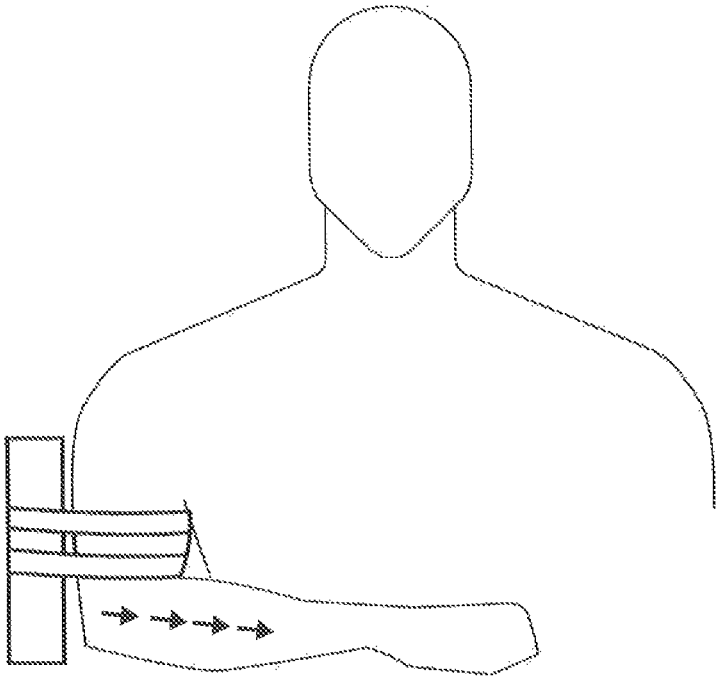
FIG. 4 depicts an illustration of the device of the invention upon stimulating the forearm.
Figure 5:
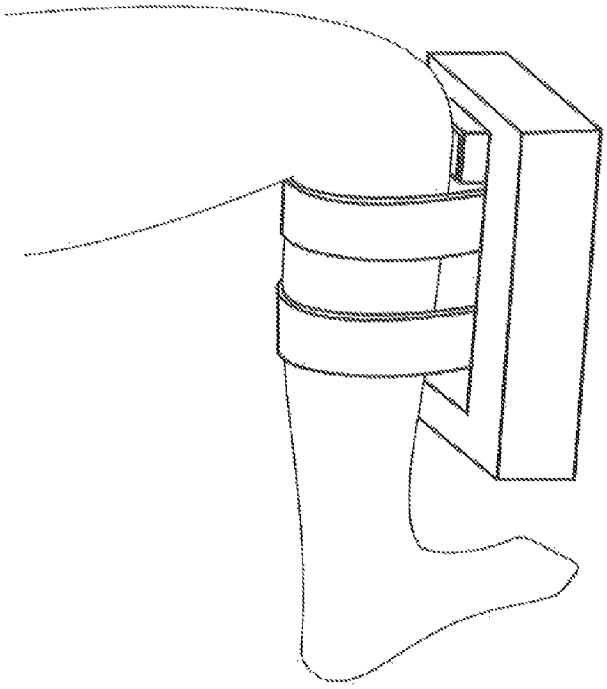
FIG. 5 depicts a close view of the device of the invention upon stimulating the leg.

The present invention relates to an osteogenesis stimulator device (bone tissue generation) capable of generating vibrations with different frequency components of frequency at the same time and which can be applied locally to different parts of the body.

The device (10) comprises a small-sized box (11) within which it is disposed an oscillating mass (15) to which the ends of two pieces parallel to each other, acting as springs, are attached (14), at whose opposite ends a permanent magnet (13) is disposed, this magnet is attached to such springs through an aluminum support (16), which in turn is attached to a steel support (17) which holds an electromagnet (12), the latter facing the permanent magnet (13).

In order to make this mass oscillate inside the box (11) a sinusoidal tension is imparted to the electromagnet (12) facing the permanent magnet (13).

To change the frequency or intensity of the oscillation, the sinusoidal tension of the electromagnet is modified. It is also necessary to modify the characteristics of the spring parts which support the mass when a significant modification of the oscillating frequency is desired.

The way of operation comprises attaching the equipment to the limb to be treated through any variable fastening means such as elastic belts or Velcro (not illustrated).

The oscillating mass inside the box moves freely supported by a kind of spring, an electromagnet imparts acceleration to the mass, thereby producing a controlled oscillation. That movement of the mass inside the box produces, through reaction, an oscillating force on the limb supporting the box. In this way, the objective of imparting a high frequency and low intensity effort to the bone structure to be treated is achieved.

The device may impart vibrations with different frequency components at the same time, better mimicking the efforts that muscles normally impart to bone structures.

It has fastening means for different parts of the body through variable fastening belts.

EXAMPLE

Bone osteogenic stimulus is produced thanks to the transmission of high frequency vibrations generated during muscle activity. The exposure of rats to the low magnitude and high frequency vibrating platform was effective to prevent bone loss in ovariectomized rats. These vibrations produce a bone enhancing both on cortical bone and on trabecular bone. Studies of postmenopausal women using this platform have shown bone mass gain in these women as opposed to the bone loss in the placebo group.

Additionally, it has been demonstrated positive effects on balance, vascular flow, muscle strength and low back pain in adults. A pilot study in children with motor disabilities has shown that children stimulated with vibration had a 15.7% net benefit of volumetric density in the tibia, and 6.7% in the spinal after 6 months using the device 4.4 minutes daily. The disadvantage of this study was a 44% compliance with the planned schedule due to the fact that children had to stand on the vibrating platform which requires an effort.

This is the first randomized, controlled, double blind study designed to prove the efficiency and tolerance of high frequency and low intensity vibrations in children with disuse osteoporosis. To date, only open studies on this type of intervention have been reported. The hypothesis was demonstrated by showing that vibrations were more effective than the conventional kinetic therapy alone for improving muscle strength, bone mass and the quality of life of these children.

In this study a net increment of 30% was observed in the placebo group and stimulated with vibrations by bone mineral densitometry in the radius. Additionally, an increment in upper limb muscle forces was observed as well as an increment in the ability to carry out daily self care activities, this item being assessed by the Quality of Life Survey, Cerebral Palsy module, PedsQL.

The observation of a larger change in BDM and area both at ultra distal radius and radius (33%), into a lower initial BDM and area respectively is an expected fact since in most of the osteoporosis treatment interventions, especially those associated with a decrease in bone resorption, the more severe the osteoporosis, the higher the effect. This represents an advantage for this intervention.

On the other hand, the finding of a better response on the left limb could be related to a lower variable initial value on the left side because most children were right handed, and thus they had used their right limb more often, therefore they had a lower degree of osteoporosis.

This last result is significant since self care is the ultimate goal of these children rehabilitation.

According to the results, the best frequency to use would be 60 Hz. To date, there has been a controversy concerning whether the best frequency to be used is 90 or 60 Hz, and thus testing the device of the invention is the first study that includes this question in the design, and it is a novel contribution to this field.

In this way, future applications of this type of intervention, both in oteoporosis and in mobility reducing pathologies, such as neurological and rheumatologic pathologies, both in adults and in children especially in the elderly is a promising fact.

Until now, this is the only high frequency and low intensity vibration stimulator which has demonstrated, through a controlled study, its efficacy and safety in children.

What is claimed is:

1. A device comprising:

a vibration generator and a variable fastener suitable for attaching to different parts of the body and wherein said device is suitable for stimulating bone tissue formation and capable of generating vibrations with different frequencies at the same time, and wherein the vibration generator comprises a permanent magnet, an electromagnet, and an oscillating mass comprising a permanent magnet, spring elements, an oscillating mass, and an electromagnet which imparts acceleration to the oscillating mass through a sinusoidal tension, wherein the electromagnet faces the permanent magnet at a uniform distance, wherein the spring elements consists of two parallel and elongated parts with opposite ends, and wherein a box containing said oscillating mass is attached to one of the ends of the spring elements, and the permanent magnet is attached to the opposite end of the spring elements.

2. The device of claim 1, wherein the electromagnet is facing the permanent magnet through a steel support.

3. The device of claim 1, wherein the variable fastener comprises elastic belts.

4. The device of claim 1, wherein the variable fastener consists of belts comprising a hook and loop fastener.

5. The device of claim 1, wherein frequencies range between 60 and 90 Hz.

* * * * *